US006099093A

United States Patent [19]

Spence

[11] Patent Number: 6,099,093

[45] Date of Patent: Aug. 8, 2000

[54] TWO USER COMPUTER DESK

[75] Inventor: Kelly Spence, Penticton, Canada

[73] Assignee: Avante Furniture Manufacturing (1992) Ltd., Okanagan Falls, Canada

[21] Appl. No.: 09/293,639

[22] Filed: Apr. 15, 1999

[30] Foreign Application Priority Data

Feb. 26, 1999 [CA] Canada ..... 2263110

[51] Int. Cl.[7] ..... A47B 27/00

[52] U.S. Cl. ..... 312/196; 312/208.1; 312/223.3; 108/50.01; 108/94

[58] Field of Search ..... 312/196, 197, 312/208.1, 223.3; 108/92, 93, 94, 102, 103, 104, 140, 143, 50.01, 50.02

[56] References Cited

U.S. PATENT DOCUMENTS 4,305,563 12/1981 Presson ..... 248/349
4,515,086 5/1985 Kwiecinski et al. ..... 108/96
4,619,427 10/1986 Leymann .
4,637,666 1/1987 Worrell et al. .
4,648,574 3/1987 Granlund .
5,526,756 6/1996 Watson ..... 108/147
5,546,708 10/1985 Wilburth ..... 108/94

*Primary Examiner*—Peter M. Cuomo
*Assistant Examiner*—Michael Fisher
*Attorney, Agent, or Firm*—Michael A. Glenn

[57] ABSTRACT

A computer desk for use by one or two users. The desk integrates a monitor platform above the desktop and a keyboard tray system below the desk surface which are connected to a vertical pivot for coordinated rotation to maintain relative alignment of the monitor and keyboard over a wide angular displacement. The desk eliminates the need to manually realign hardware components when sharing use of a computer, thereby reducing wear and risk of unintentional disconnection of cables, while maintaining a maximal amount of desktop working space and allowing ergonomically and aesthetically favorable suspension of the keyboard below the desktop of the desk.

2 Claims, 6 Drawing Sheets

TWO USER COMPUTER DESK

TECHNICAL FIELD OF THE INVENTION

The present invention relates generally to furniture, and more particularly to a desk accommodating computer usage.

BACKGROUND OF THE INVENTION

The computer is widely established as integral to most office and industry environments, and is quickly becoming a common fixture in many households. Various desks have also been developed to facilitate working with a computer. However, existing computer desks fail to enable users to maximize the potential of the computer.

There are several contexts in which two users may want to operate a computer together. In workplace training sessions an instructor and student, or two students, often share a keyboard and monitor. Similarly, in the educational environment, shared use of a computer allows teachers or peers to observe and offer timely feedback. In the entertainment environment, increasingly popular computer games often are intended for play by two people.

Existing computer desks make the use of one computer by two users cumbersome. Following use by the first user, in order for the second user to gain proper access to the computer, the keyboard and monitor must be manually maneuvered in order to allow the second user to have full access, or the users must exchange seats to allow the second user access.

This physical movement of the hardware is cumbersome and time-consuming, serving as an inconvenience which interrupts the flow of a training session or game play. Such movement also increases the risk that hardware components will become disconnected or sustain damage.

There are a number of desirable objectives in relation to computer desks for two users. Such desks should allow coordinated realignment of the monitor and keyboard between users, and the time and effort required to carry out such realignment should be minimal.

It is known to provide a computer desk which could be used by two users. An example of such a device is disclosed in U.S. Pat. No. 4,637,666 to Worrell et al. The Worrell patent teaches the concept of a desk having a rotatable underlying keyboard tray and a rotatable surface-mounted monitor platform. In Worrell, rotation of the monitor and keyboard is not coordinated, and the keyboard tray is not extendible toward the user.

It is known to provide a computer support stand which simultaneously allows for coordinated rotation of a monitor and keyboard, and extension of the keyboard towards the user, which could potentially accommodate two users. Such a stand is described in U.S. Pat. No. 4,648,574 to Granlund. In Granlund, however, the keyboard tray is contiguous with the monitor support platform. The support platform is large and occupies a large portion of a desktop. In addition, extension of the keyboard tray creates a cavity which renders the platform surface ineffective as a desktop.

It is also known to provide a support assembly for a computer which allows coordinated rotation of the monitor and keyboard, and reversible extension of the keyboard toward the user. Such an assembly is described in U.S. Pat. No. 4,619,427 to Leymann. The Leymann invention is not practiced as an integral part of a computer desk and Leymann states that it is an object of the invention to provide a computer stand which can be used independently of supporting surfaces such as desktops.

It is therefore an object of the present invention to provide a computer desk with an integrated assembly which allows coordinated rotation of a single monitor and keyboard between two computer users.

It is a further object of the invention to provide such an assembly which can be realigned with minimal physical effort and time, and which minimizes the risk of component damage or disconnection.

It is a further object of the invention to provide a computer desk which has a large available desktop working space, including space for operation of a mouse or similar device, and a keyboard tray which is suspended below the level of the desktop and which can be concealed beneath the desktop. Suspension of the keyboard is desirable to reduce workplace injury by allowing a more ergonomically favourable work position, while concealment of the keyboard improves office aesthetics.

SUMMARY OF THE INVENTION

The computer desk according to the present invention is designed to allow two users to sit or stand side by side at the desk and to gain full access to a single keyboard and monitor without having to move from their positions.

In one of its aspects, the computer desk according to the invention comprises a desktop, an opening in the desktop, a monitor platform above the desktop, a keyboard platform below the desktop, and rotatable means extending through the desktop connecting the keyboard platform to the monitor platform.

In another of its aspects, the invention further comprises a keyboard platform which is extendible toward a computer user.

In still another of its aspects, the invention comprises a computer desk having a desktop, an opening in the desktop, a support means in spaced relationship with and below the desktop, and a monitor and keyboard support assembly. The monitor and keyboard support assembly comprises a ball bearing swivel plate attached to the support means, a keyboard tray guide and a keyboard tray slidably attached to the guide which is itself attached to the swivel plate, a vertical support column attached to the keyboard tray guide and extending through the opening, and a monitor platform attached to the support column above the desktop.

It is yet another aspect of the invention that the keyboard tray guide and the monitor platform are rigidly connected to the support column in a common orientation.

Other features of the invention are defined by the claims and will become apparent from the following detailed description of the preferred and alternative embodiments.

BRIEF DESCRIPTION OF THE DRAWINGS

The preferred embodiment of the invention will be described in association with the drawings in which.

DETAILED DESCRIPTION OF BEST MODE AND PREFERRED EMBODIMENT OF THE INVENTION

Figure 1:
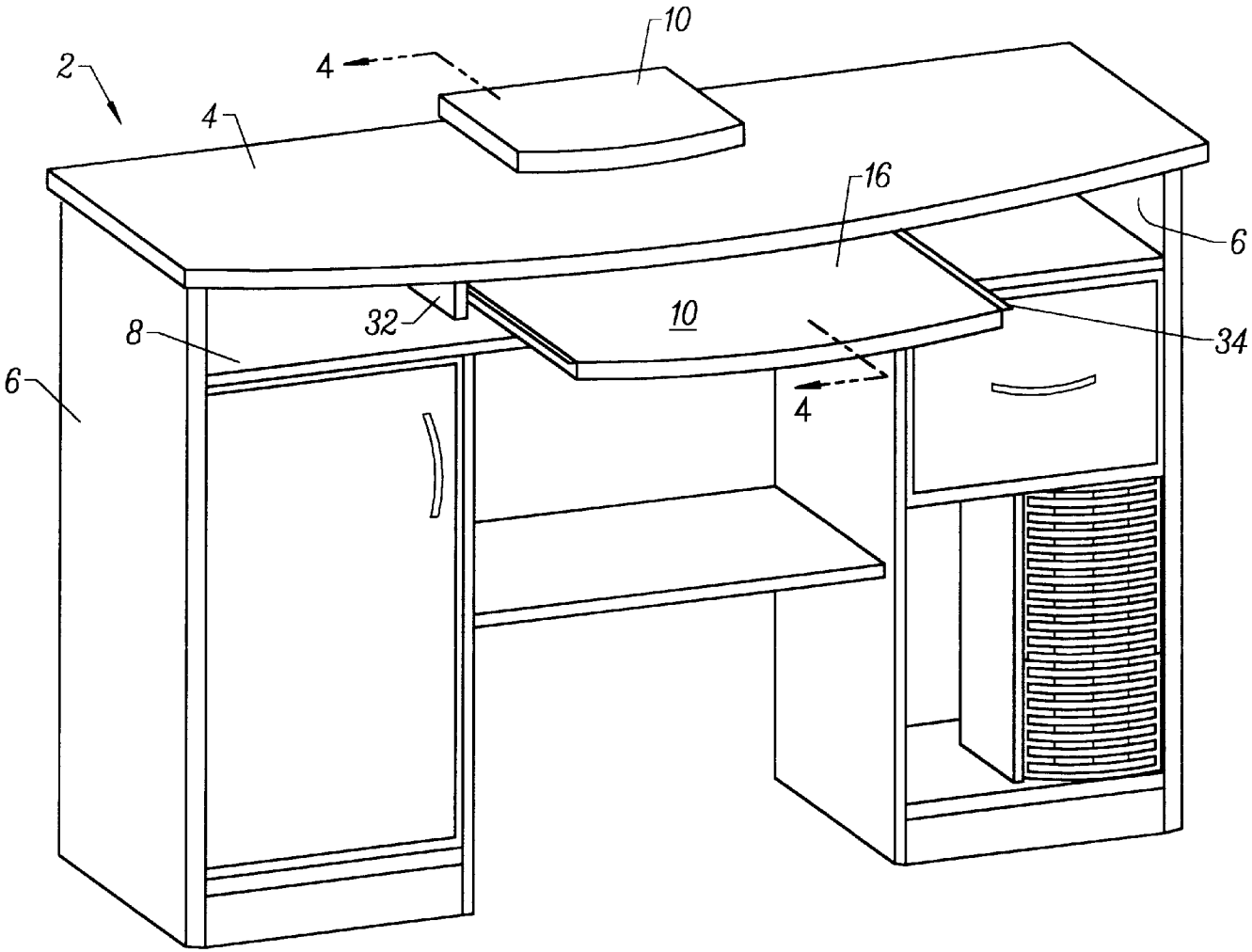
FIG. 1 is a perspective front view of the assembly according to the invention showing the monitor and keyboard support assembly rotated to a central position.
Figure 2:
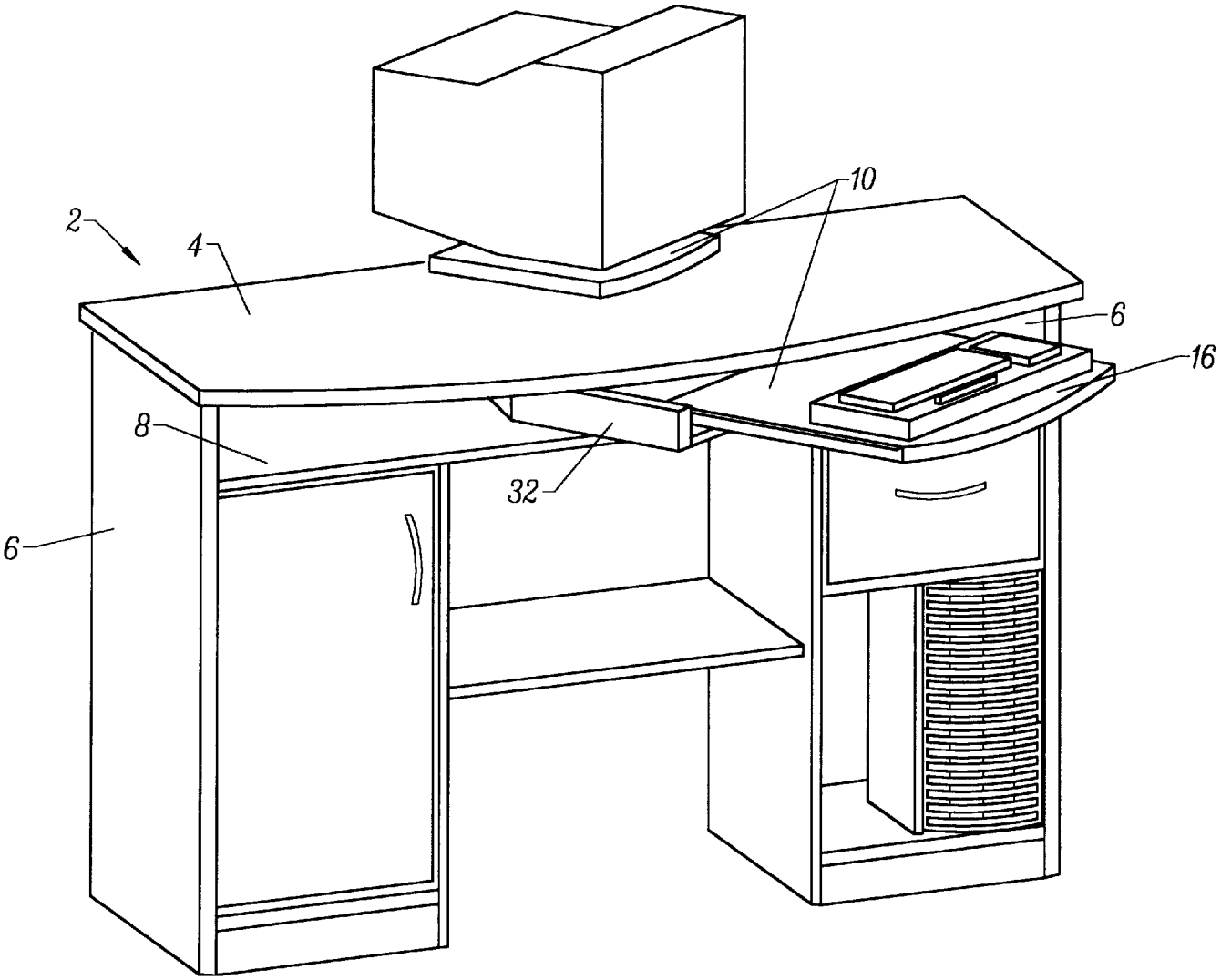
FIG. 2 is a perspective front view of the assembly according to the invention showing the monitor and keyboard support assembly fully rotated to the right and with a computer monitor and keyboard in place.

Referring to FIGS. 1 and 2, the desk 2 according to the invention comprises an upper desktop 4, a vertical support 6 extending downwardly from each longitudinal end of the desktop, horizontal support means 8 extending between the vertical supports 6 a fixed distance below the desktop 4, and a monitor and keyboard support assembly 10.

Figure 3:
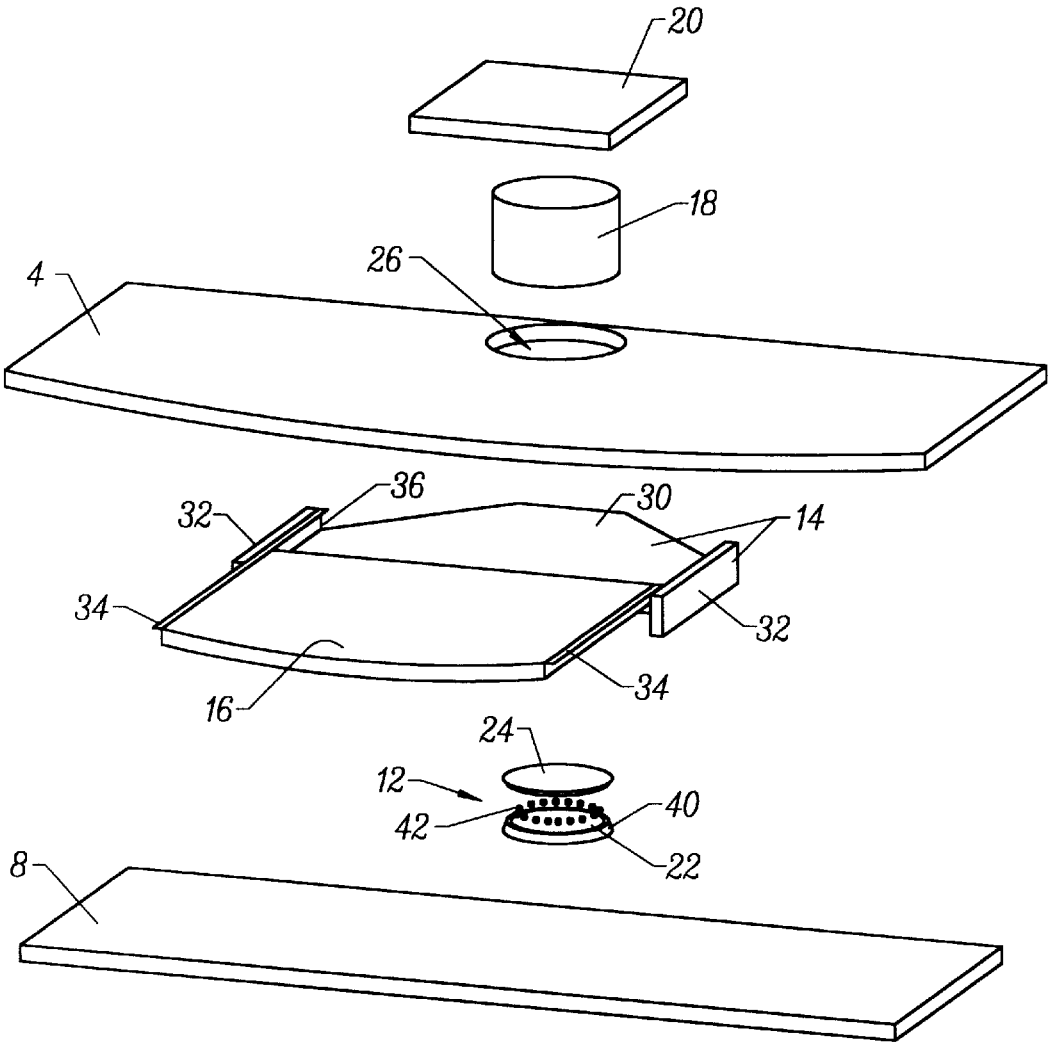
FIG. 3 is a perspective front exploded view of the monitor and keyboard support assembly according to the invention.
Figure 4:
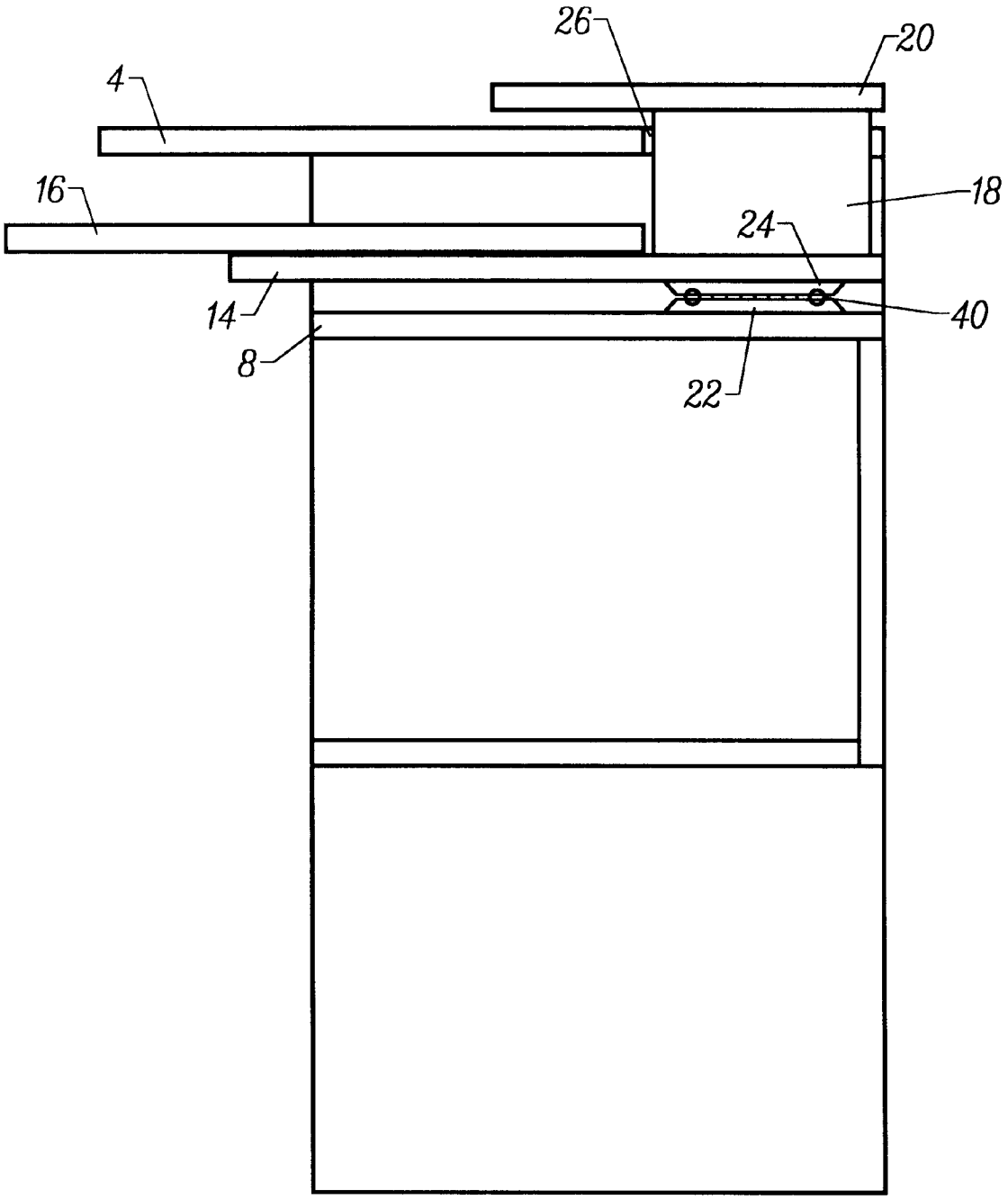
FIG. 4 is a transverse cut-away view of the desk according to the invention taken along line 4—4 of FIG. 1, showing the keyboard tray fully retracted.
Figure 5:
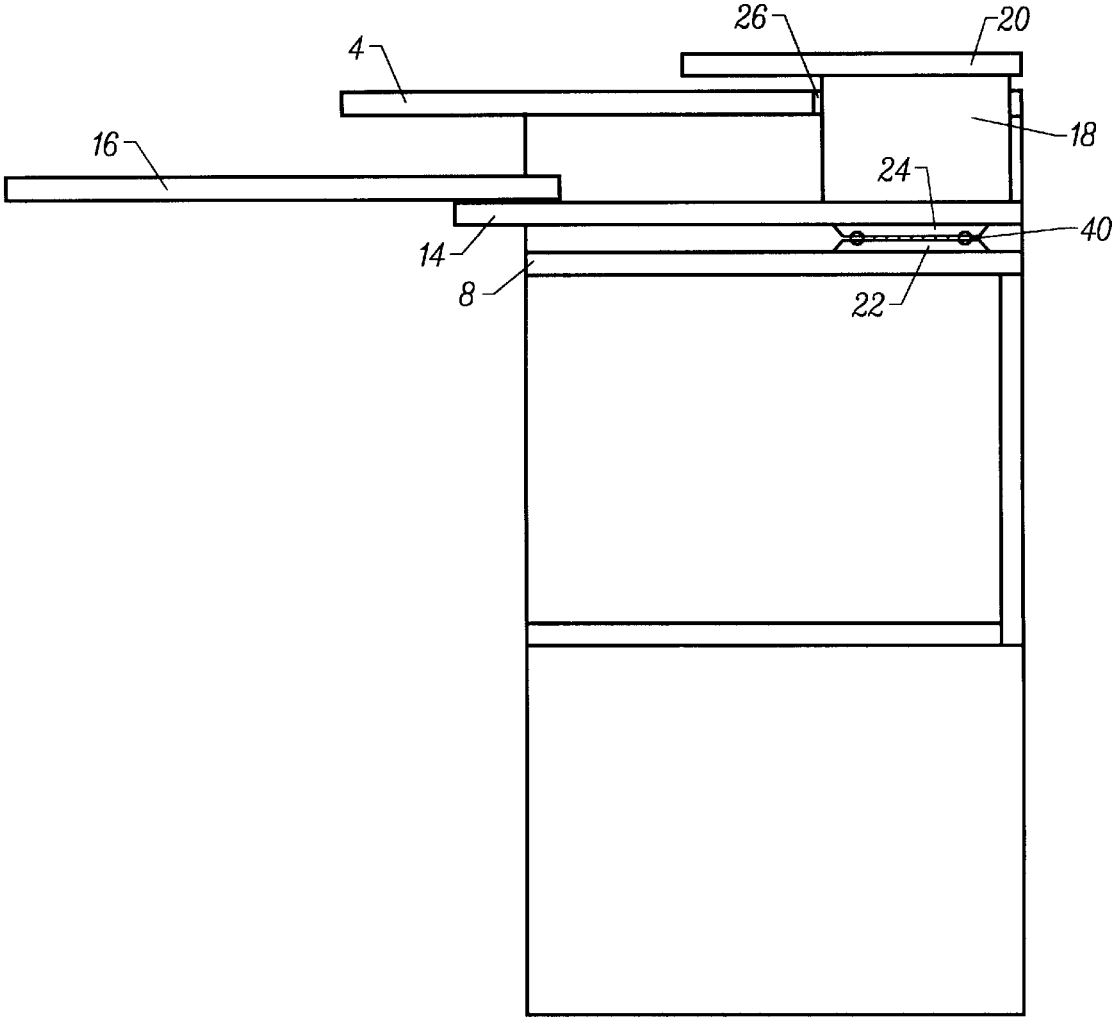
FIG. 5 is a transverse cut-away view of the desk according to the invention taken along line 4—4 of FIG. 1, showing the keyboard tray fully extended.

As indicated in FIGS. 3, 4, and 5 the monitor and keyboard support assembly 10 comprises a ball bearing swivel plate 12, a keyboard tray guide 14, a slide-out keyboard tray 16, a support column 18, and a monitor platform 20.

In the preferred embodiment, the vertical supports 6 are of a height which allows seated users easy access to a keyboard mounted on the keyboard tray 16. In an alternative embodiment, the vertical supports 6 are longer to allow access to the keyboard by users who are in a standing position.

In the preferred embodiment, the lower portion 22 of the ball bearing swivel plate 12 is connected with screws (not shown) to the upper side of the support surface 8. The upper portion 24 of the swivel plate 12 is connected with screws (not shown) to the lower side of the keyboard tray guide 14. The lower end of the support column 18 is attached with screws (not shown) to the rearward upper side of the keyboard tray guide and extends upwardly through an opening 26 in the desktop 4. The upper end of the support column 18 is attached with screws (not shown) to the lower side of the monitor platform 20.

Figure 6:
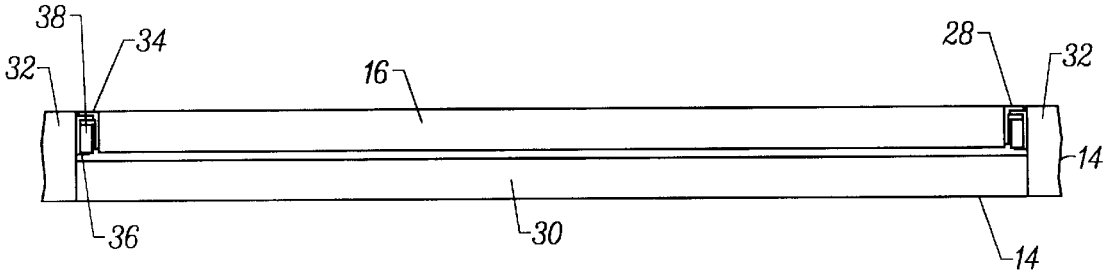
FIG. 6 is a front view of the keyboard tray system according to the invention.

As shown in FIGS. 3 and 6, the keyboard tray 16 and the keyboard tray guide 14 are slidably connected by drawer runner means 28. The keyboard tray guide is generally channel shaped, comprising a rectangular planar portion 30 and vertical side pieces 32 extending upwardly from each lateral side of the planar portion. Each side of the keyboard tray 16 is attached by the drawer runner means 28 to the inner surface of the vertical side piece to allow reversible extension of the keyboard tray 16 toward the user. In its fully extended mode, the keyboard tray 16 extends beyond the front edge of the desktop 4 to allow user access to a keyboard resting on the tray 16. In its fully retracted mode, most of the keyboard tray 16 is below the desktop 4 but the rearward edge of the tray does not make contact with the support column 18.

The drawer runner means 28 connecting each side of the keyboard tray 16 to the keyboard tray guide 14 comprise inner 34 and outer 36 interacting guide rails. The inner guide rail 34 is an elongated inverted-L shaped strip with forward and rearward ends. A rotatable wheel 38 is fixed near the rearward end of the strip. One inner guide rail 34 is screwed to the outer edge of each side of the keyboard tray 16. The outer guide rail 36 comprises an elongated rectangular channel with forward and rearward ends. A rotatable wheel (not shown) is fixed near the forward end of the channel. One outer guide rail 36 is fixed to the inner surface of each vertical side piece of the keyboard tray guide 14. The inner and outer guide rails are adapted to interconnect in sliding engagement, allowing reversible extension of the keyboard tray 16 relative to the keyboard tray guide 14.

As shown in FIGS. 3, 4 and 5, the ball bearing swivel plate 12 comprises upper 24 and lower 22 flat circular portions each having a circular groove 40 near its perimeter on its inside face. In operation, the two portions are loosely riveted face to face at their centre points such that the two grooves are brought together to form a circular hollow tube which houses a continuous row of ball bearings 42. The swivel plate thus formed allows rotation of the upper portion 24 relative to the lower portion 22 about a vertical axis at its centre.

Application of a lateral force to the keyboard tray 16, keyboard tray guide 14, or monitor platform 20, or to a monitor or keyboard mounted thereon, will effect coordinated rotation of the monitor and keyboard support assembly 10 as a unit. In this way, the relative orientation of the monitor platform 20 and the keyboard tray 16 remains unchanged. In the embodiment shown in FIG. 2, the support assembly 10 can be rotated fully to the right to allow access by a user seated or standing at the right side of the desk 2. Alternatively, the support assembly 10 can be rotated fully to the left to allow access to a user seated or standing at the left side of the desk 2, without the other user having to change positions.

When a keyboard and monitor are placed on the keyboard tray 16 and monitor platform 20, as seen in FIG. 2, rotation of the support assembly 10 will maintain the alignment of the keyboard and monitor, eliminating the need for manual realignment of the monitor and keyboard when a computer is shared between two users.

It will be appreciated by those skilled in the art that other variations of the preferred embodiment may also be practiced without departing from the scope of the invention.

What is claimed is:

1. A computer desk comprising:

a desktop;

an opening in the desktop;

a support means in spaced relationship with and below the desktop; and a monitor and keyboard support assembly comprising:

a ball bearing swivel plate attached to said support means, a keyboard tray guide and a keyboard tray slidably attached to the guide, said keyboard tray guide being attached to said swivel plate, a vertical support column attached to the keyboard tray guide and extending through said opening, and a monitor platform attached to said support column above said desktop.

2. The desk of claim 1 wherein said keyboard tray guide and said monitor platform are rigidly connected to the support column in a common orientation.

* * * * *